US008783373B2

(12) United States Patent
Pahila et al.

(10) Patent No.: US 8,783,373 B2
(45) **Date of Patent: *Jul. 22, 2014**

(54) EXTENDED COVERGE HORIZONTAL SIDEWALL SPRINKLER

(75) Inventors: Oliver S. Pahila, Liberty, SC (US); Ricardo Goldberg, Liberty, SC (US)

(73) Assignee: The Reliable Automatic Sprinkler Co., Inc., Liberty, SC (US)

( * ) Notice: Subject to any disclaimer, the term of this patent is extended or adjusted under 35 U.S.C. 154(b) by 724 days.

This patent is subject to a terminal disclaimer.

(21) Appl. No.: 12/956,985

(22) Filed: Nov. 30, 2010

(65) Prior Publication Data

US 2011/0127050 A1 Jun. 2, 2011

Related U.S. Application Data

(63) Continuation-in-part of application No. 11/408,369, filed on Apr. 21, 2006, now Pat. No. 7,841,418.

(51) Int. Cl.
*A62C 37/08* (2006.01)

(52) U.S. Cl.
USPC ..... 169/37; 239/223; 239/461; 239/518; 239/523

(58) Field of Classification Search
USPC ..... 169/37; 239/223, 498, 499, 504, 523, 239/524
See application file for complete search history.

(56) References Cited

U.S. PATENT DOCUMENTS

| | | | | |
|---|---|---|---|---|
| 1,943,073 | A | 1/1930 | Heverly et al. | 239/222.19 |
| 1,778,994 | A | 10/1930 | Allen | 239/275 |
| 2,046,169 | A | 6/1936 | Knight | 239/504 |
| 2,101,694 | A | 12/1937 | Tyden | 239/500 |
| 2,465,420 | A | 3/1949 | Barnett | 239/222.17 |
| 2,481,363 | A | 9/1949 | Strock | 239/222.17 |
| 3,146,823 | A | 9/1964 | Loveland | 239/518 |
| 3,904,126 | A | 9/1975 | Allard | 239/502 |

(Continued)

FOREIGN PATENT DOCUMENTS

| | | | | |
|---|---|---|---|---|
| GB | 2103481 | A | 2/1983 | A62C 37/10 |
| GB | 2206043 | A | 12/1988 | A62C 37/10 |
| JP | 2003180862 | A | 7/2003 | A62C 37/12 |
| JP | 2003275336 | A | 9/2003 | A62C 37/11 |

OTHER PUBLICATIONS

Communication Pursuant to Article 94(3) EPC. May 5, 2010. Issued in European Patent Application No. 07 760 993.1. 4 pages.

(Continued)

*Primary Examiner* — Dinh Q Nguyen
(74) *Attorney, Agent, or Firm* — Fitzpatrick, Cella, Harper & Scinto

(57) ABSTRACT

A sidewall fire protection sprinkler, including a deflector having a central portion curved about a first, horizontal axis that is transverse to a second axis that extends in an output direction of the sprinkler. End portions extend outwardly from the central portion along the first axis, the end portions each respectively including an upper part and a lower part separated by a gap which defines an elongated notch extending between the upper part and the lower part at an innermost portion of the gap adjacent to the central portion. The gap is formed extending outwardly from the central portion substantially along the first axis. Planar portions extend respectively from top edges of the upper parts of the end portions. The planar portions extend in the output direction. The sprinkler can provide extended coverage ordinary hazard protection.

31 Claims, 6 Drawing Sheets

(56) References Cited

U.S. PATENT DOCUMENTS

| | | | | |
|---|---|---|---|---|
| 4,296,815 | A | 10/1981 | Mears | 169/37 |
| 4,296,816 | A | 10/1981 | Fischer | 169/37 |
| 4,585,069 | A | 4/1986 | Whitaker | 169/37 |
| 4,987,957 | A | 1/1991 | Galaszewski | 169/37 |
| 5,447,338 | A | 9/1995 | Kikuchi | 285/46 |
| 5,669,449 | A | 9/1997 | Polan et al. | 169/16 |
| 5,722,599 | A | 3/1998 | Fries | 239/504 |
| 5,727,737 | A | 3/1998 | Bosio et al. | 239/504 |
| 5,810,263 | A | 9/1998 | Tramm | 239/518 |
| 5,915,479 | A | 6/1999 | Ponte | 169/46 |
| 6,076,746 | A | 6/2000 | Kantor et al. | 239/222.17 |
| 6,098,718 | A | 8/2000 | Sato | 169/37 |
| 6,367,559 | B1 | 4/2002 | Winebrenner | 169/37 |
| 6,374,919 | B1 | 4/2002 | Neill | 169/37 |
| 6,374,920 | B1 | 4/2002 | Phillips et al. | 169/37 |
| 6,520,265 | B2 | 2/2003 | Winebrenner | 169/37 |
| 6,540,261 | B1 | 4/2003 | Painter et al. | 285/133.11 |
| 6,799,639 | B2 | 10/2004 | Sato et al. | 169/37 |
| 6,805,203 | B2 | 10/2004 | Retzloff et al. | 169/37 |
| 6,889,774 | B2 | 5/2005 | Multer et al. | 169/37 |
| 6,920,937 | B2 | 7/2005 | Neill et al. | 169/37 |
| 7,137,455 | B2 | 11/2006 | Green | 169/37 |
| 7,841,418 | B2 * | 11/2010 | Pahila et al. | 169/37 |
| 8,151,897 | B1 * | 4/2012 | Meyer et al. | 169/41 |
| 2002/0056763 | A1 | 5/2002 | Winebrenner | 239/209 |
| 2002/0129946 | A1 | 9/2002 | Retzloff et al. | 169/37 |
| 2003/0111237 | A1 | 6/2003 | Sato et al. | 169/37 |
| 2003/0160111 | A1 | 8/2003 | Multer et al. | 239/209 |
| 2003/0222155 | A1 | 12/2003 | Neil et al. | 239/208 |
| 2005/0045739 | A1 | 3/2005 | Multer | 239/209 |
| 2005/0067171 | A1 | 3/2005 | Green | 169/16 |

OTHER PUBLICATIONS

"Series TY-L—5.6 K-Factor Horizontal Sidewall Sprinklers Standard Response, Standard Coverage." Tyco Fire Products, Lansdale, PA, Jan. 2003.

"Series TY-FRB—5.6 and 8.0 K-Factor Extended Coverage Horizontal Sidewall Sprinklers Quick & Standard Response (Light Hazard)." Tyco Fire Products, Lansdale, PA, Jan. 2003.

"Model SW-20 and SW-24—11.2 K-Factor Extended Coverage Ordinary Hazard Horizontal Sidewall Sprinklers (Standard Response)." Tyco fire Products, Lansdale, PA, Apr. 2003.

"Model CHEC—8.0 K-Factor Concealed Horizontal Extended Coverage Quick Response Light Hazard, Sidewall Sprinklers." Tyco Fire Products Lansdale, PA, Apr. 2004.

"Series LFII Residential Horizontal Sidewall Sprinklers 4.2 K-Factor." Tyco Fire Products, Lansdale, PA, Apr. 2004.

http://www.victaulic.com/cms_system/PrintPage.asp?site_id=1&page_id=301.

http://www.fergusonfire.com/pdfs/Sec10.pdf.

* cited by examiner

EXTENDED COVERGE HORIZONTAL SIDEWALL SPRINKLER

CROSS-REFERENCE TO RELATED APPLICATION

This application is a continuation-in-part of U.S. patent application Ser. No. 11/408,369, filed Apr. 21, 2006, the entire contents of which are incorporated herein by reference.

BACKGROUND

1. Field

The present invention relates to an automatic fire protection sprinkler, and in particular an extended coverage, horizontal sidewall sprinkler for light hazard occupancies.

2. Related Art

Fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb or fusible link, and may also include a latching mechanism.

Certain conventional sprinklers have a pair of arms that extend from the base portion and meet at a hub portion to form a frame. The hub portion is spaced apart from the output orifice of the base portion and is aligned with a longitudinal axis thereof. The hub portion may have a set-screw configured to apply a pre-tension force to the release mechanism. A deflector may be mounted on the hub, transverse to the output orifice, to provide dispersion of the output fluid.

Fire protection sprinklers may be mounted on a fluid conduit running along a ceiling and may either depend downward from the conduit, which is referred to as a "pendent" configuration, or may extend upward, which is referred to as an "upright" configuration. Alternatively, a sprinkler may be mounted on a wall, a certain distance below the ceiling, which is referred to as a "horizontal sidewall" configuration. Horizontal sidewall sprinklers have an output orifice that is oriented so that the fluid is output horizontally and sprays onto an area to be protected in front and to the sides of the sprinkler. Such sprinklers may be mounted in a supporting cup with an escutcheon and cover, to provide a concealed configuration.

NFPA 13 ("Standard for the Installation of Sprinkler Systems," National Fire Protection Association, Inc., 2002 Edition) classifies automatic sprinklers according to "occupancies," which define requirements for sprinkler design, installation, and water supply requirements. Light hazard occupancies are defined as areas in which the quantity and/or combustibility of contents is low, and fires with relatively low rates of heat release are expected (NFPA 13, Section 5.2).

As described in Section 5.9 of UL 199 ("Standard for Automatic Sprinklers for Fire-Protection Service," Underwriters' Laboratories, 11$^{th}$ Ed., Nov. 4, 2005), an "extended coverage" sprinkler for light hazard occupancies is a sprinkler intended: a) for use at greater than standard spacing; b) to open automatically by operation of a heat responsive element and releasing mechanism having a response time equal to or less than a standard response sprinkler used on standard spacings; c) to discharge water over a specified coverage area at a specified minimum water flow rate; and d) for use in light hazard occupancies as described in NFPA 13.

According to Section 8.9 of NFPA 13, extended coverage sidewall sprinklers for light hazard occupancies may have a spacing of up to 28 ft between sprinklers, as measured along the wall on which the sprinklers are mounted, and may cover an area of up to 400 ft$^2$.

SUMMARY OF THE INVENTION

In one aspect, the present invention provides a sidewall fire protection sprinkler, including a deflector having a central portion curved about a transverse axis from an output direction of the sprinkler; end portions extending along the transverse axis outwardly from the central portion, the end portions having an upper part and a lower part separated by a gap; and planar portions extending in the output direction from a top edge of the end portions.

Embodiments of the present invention may include one or more of the following features.

The planar portions may be angled downward with respect to the transverse axis. The planar portions may be angled downward with respect to the output direction. A width of the planar portions along the transverse axis may be substantially less than a width of the end portions along the transverse axis. The planar portions may extend farther in the output direction than any other portion of the deflector.

The end portions may be curved about the transverse axis with a radius increasing in a direction away from the central portion. The lower parts of the end portions have a slot that is angled with respect to the transverse axis.

The nominal K-factor of the sprinkler may be 5.6. For a coverage area of 28 ft along a wall by 10 ft forward throw, the sprinkler may require a system pressure of less than about 25 psi and flow rate of less than about 28 gpm. For a coverage area of 28 ft along a wall by 8 ft forward throw, the sprinkler may require a system pressure of less than about 17 psi and flow rate of less than about 23 gpm. The nominal K-factor may be larger or smaller than 5.6, however, and in fact may be as small as about 2.8, or may be as large as 15 or 16. In some preferred embodiments the nominal K-factor may be 8, 11.2 or 14. The use of various K-factors will involve use of appropriate water pressures to obtain the intended coverage, but those in the art will not require more detailed disclosure to determine the proper pressure.

In another aspect of the invention, a horizontal sidewall fire protection sprinkler is provided including a deflector having a central portion curved about a first, horizontal axis that is transverse to a second axis that extends in an output direction of the sprinkler. End portion extend outwardly from the central portion along the first axis, the end portions each respectively including an upper part and a lower part separated by a gap which defines an elongated notch extending between the upper part and the lower part at an innermost portion of the gap adjacent to the central portion. The gap is formed extending outwardly from the central portion substantially along the first axis. Planar portions extend respectively from top edges of the upper parts of the end portions, wherein the planar portions extend in the output direction. The sprinkler has a k-factor greater than 5.6.

In other aspects of the invention, a recessed horizontal sidewall sprinkler, a concealed horizontal sidewall sprinkler, and a dry horizontal sidewall sprinkler are provided.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

DETAILED DESCRIPTION OF THE PREFERRED EMBODIMENTS

Figure 1:
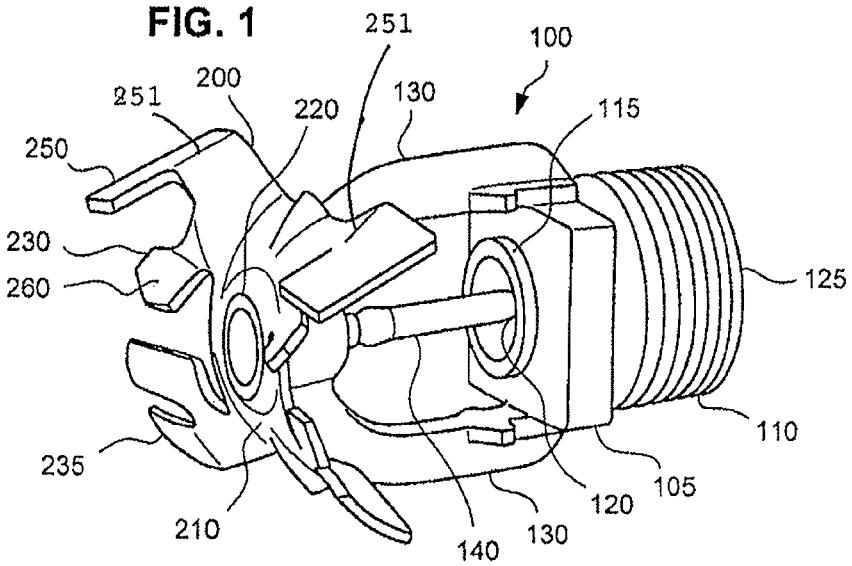
FIG. 1 is a perspective view of one embodiment of a horizontal sidewall sprinkler, in accordance with the present invention.
Figure 2:
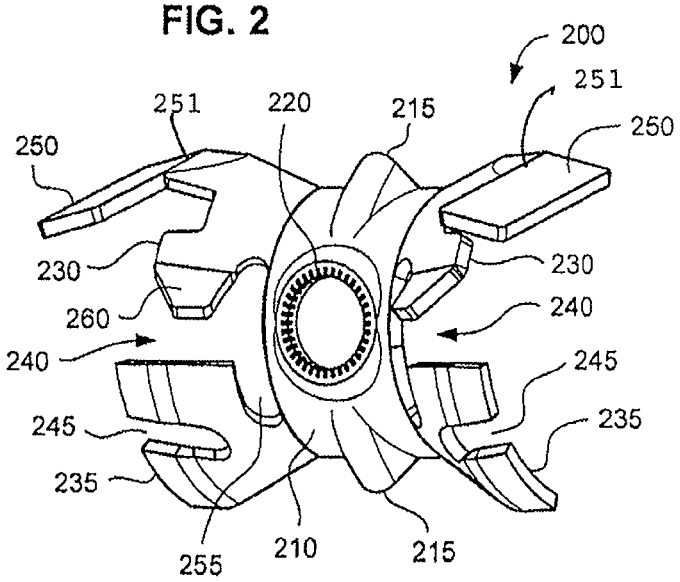
FIG. 2 is an isometric view of the deflector of the sprinkler of FIG. 1.
Figure 3:
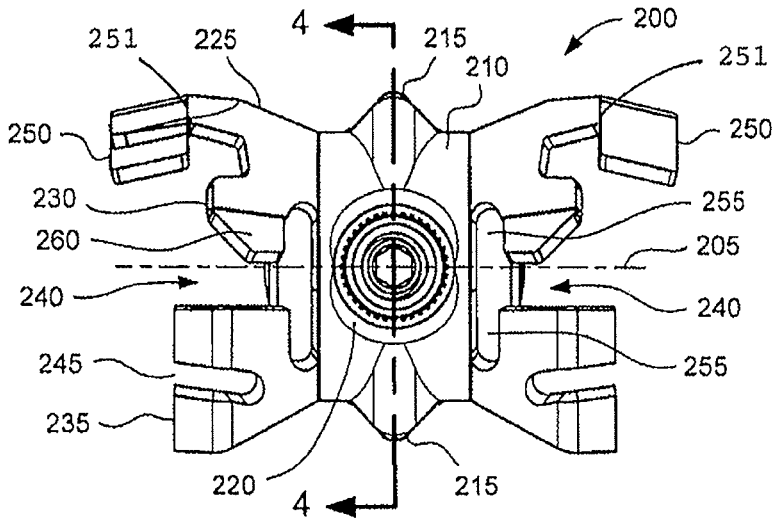
FIG. 3 is a plan view of the deflector of FIG. 2 showing the surface that faces away from the outlet orifice.
Figure 4:
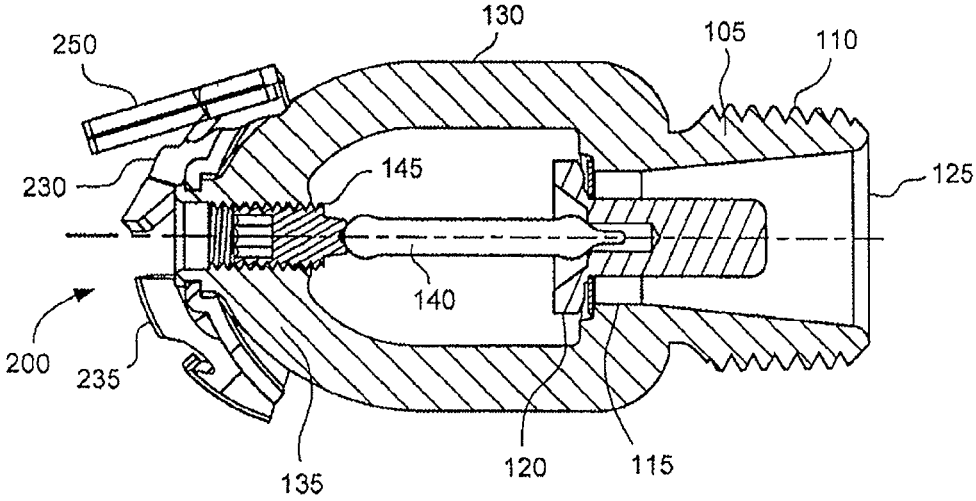
FIG. 4 is a sectional view of the sprinkler of FIG. 1 in a vertical plane through the frame arms.
Figure 5:
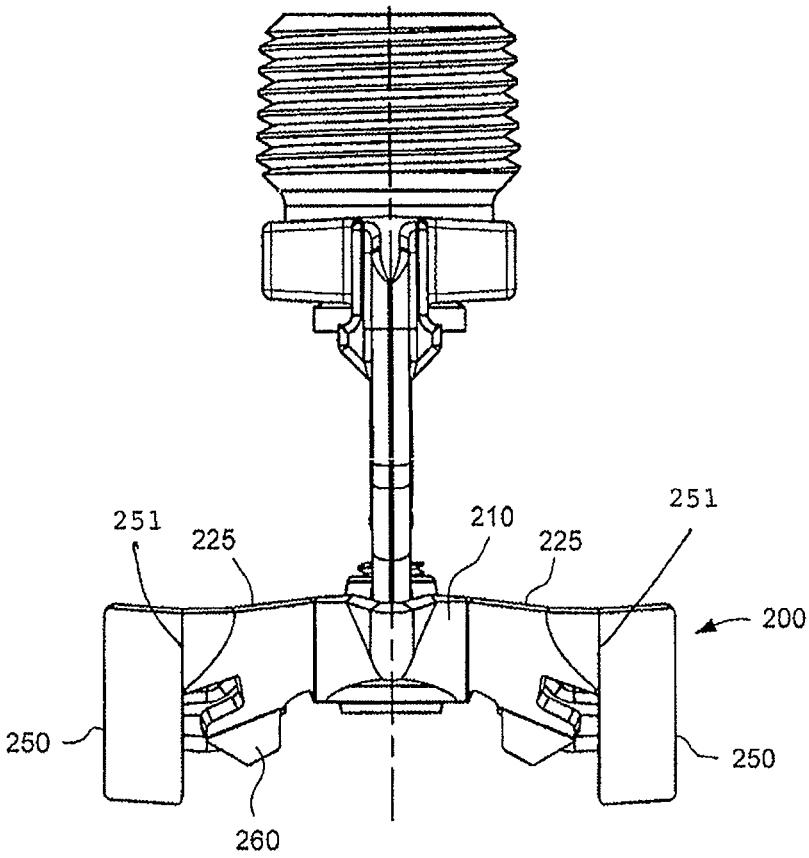
FIG. 5 is a top, plan view of the sprinkler of FIG. 1.
Figure 6:
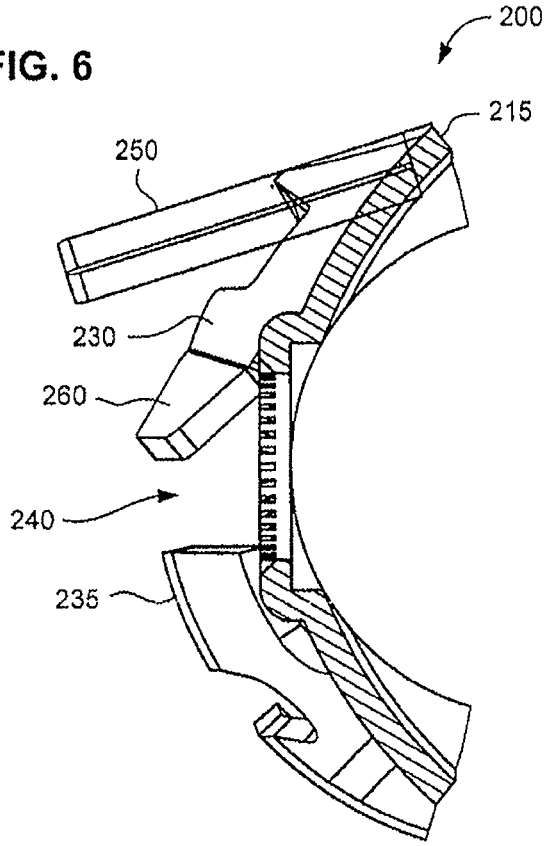
FIG. 6 is a sectional view of the deflector of FIG. 2 in a vertical plane through the center of the deflector.

FIGS. 1-6 show a horizontal sidewall sprinkler 100, in accordance with a preferred embodiment, which is configured to extend horizontally from a wall (not shown), a predetermined distance from the ceiling. The sprinkler 100 has a body 105 defining an axial fluid passage having a horizontal output direction, which is perpendicular to the wall. The body has a threaded portion 110 on its outer surface to allow the sprinkler 100 to be connected to a conduit (not shown) for providing pressurized fire-extinguishing fluid, such as water, to an input end of the fluid passage. The fluid passage has an output orifice 115 at the opposite end that is sealed by a seal cap 120. The input end 125 of the fluid passage may have a diameter of, for example, ½ inch NPT (national pipe thread). The sprinkler 100 may have a K-factor of, for example, 5.6, which is defined by $K=Q/\sqrt{p}$, where Q is the flow rate in gallons per minute and p is the residual pressure at the inlet of the sprinkler in pounds per square inch.

Two frame arms 130 extend from the body 105 in a vertical plane perpendicular to the wall and meet at a hub 135 (see FIG. 4) positioned in front of and in axial alignment with the output orifice 115. A deflector 200 is positioned on the hub 135 so as to be impinged on by the output fluid upon activation of the sprinkler 100. As further discussed below, the deflector 200 is centered on hub 135 and has a generally horizontal orientation, along an axis 205 transverse to the output direction of the sprinkler 100. The deflector 200 is curved along the transverse axis 205 (see FIGS. 2 and 3) toward the output orifice 115. The width of the deflector 200 in the transverse direction can be between about 1.0 and about 2.5 inches and in this embodiment is, e.g., about 1.9 inches. The deflector 200 has a height that increases toward the ends of the deflector. The height at the outer ends can be between about 0.75 and about 2.0 inches and in this embodiment is, e.g., about 1.25 inches. The deflector defines an arc about the transverse axis which can be between about 100° and about 180° and in this embodiment is, e.g., about 150°.

A release mechanism having a thermally-responsive element, e.g., a frangible bulb 140, is positioned between the hub 135 and the seal cap 120 to hold the seal cap 120 in place over the output orifice 115. As shown in the sectional view of FIG. 4, the bulb 140 is positioned between the seal cap 120 and a set screw 145. The bulb 140 bursts at the predetermined temperature, which in turn releases the seal cap 120 and allows the fluid to be output from the orifice 115. Of course, other types of release mechanisms may be used, including, but not limited to, for example, a fusible link assembly or a sensor, strut, and lever assembly.

The deflector 200 has a central portion 210 that is curved toward the body 105 of the sprinkler 100 about the transverse axis 205. The central portion 210 has a raised portion 215 with a radius of between about 0.5 inch and about 2.5 inches, preferably about 0.8 inch, in a vertical plane at the center of the deflector 200, orthogonal to the transverse axis 205 (see FIG. 6), which allows this portion 215 of the deflector to fit around the ends of the arms 130 of this particular sprinkler. On either side of the arms 130, the central portion has a radius of between about 0.3 inch and about 0.7 inch, preferably about 0.4 inch. A circular portion 220 having a radius of about 0.4 inch is provided in the center of the central portion 210 to allow the deflector 200 to be attached to the end of the hub 135.

The end portions 225 of the deflector extend outwardly from the central portion 210 along the transverse axis 205. The radius of the end portions 225 increases linearly with distance in the transverse direction away from the center of the deflector 200, resulting in the end portions 225 having a generally conical shape. The end portions 225 are divided into an upper 230 and lower part 235 with a gap 240 between these parts. The lower parts 235 have a vertical end edge with a slot 245 that is angled with respect to the transverse direction, as shown, for example, in FIG. 3. The upper parts 230 end in nearly horizontal planar portions 250, as further described below. Vertically-oriented notches 255 are formed in the innermost portion of the gap 240 between the upper 230 and lower parts 235. A tab 260 extends from the upper part 230 into the gap 240, next to the notches 255, and this tab 260 is angled to extend outward in the output direction.

The planar portions 250 extend in the output direction from the top edges of the end portions 225 and are generally rectangular, with the longer dimension extending in the output direction. For example, the length of the planar portion may be about 0.7 inch. The width of the planar portion 250 measured in the transverse direction is, e.g., about 0.25 inch (about 0.3 inch measured along the surface of the planar portion), which is substantially less than the width of the end portions 225 in the transverse direction, e.g., about 0.7 inch. The planar portions are angled downward in both the output direction and the transverse direction. For example, the planar portions 250 may be angled downward by, e.g., about 17° (± about 10%) in the output direction and, e.g., about 13° (± about 10%) in the transverse direction. The planar portions 250 extend farther in the output direction than any other portion of the deflector (see FIGS. 4-6).

The planar portions help project fluid to the sides in a diagonal direction toward the corners of the spray pattern, thereby forming a wide rectangular pattern, while maintaining the desired density throughout the spray pattern. For example, the sprinkler may be used as an extended coverage sidewall sprinkler at a wall spacing of 28 ft and a forward throw of about 10 ft. In an alternative embodiment, the sprinkler may have a forward throw of about 8 ft. Such patterns are particularly useful in long, relatively narrow spaces, such as hallways or decks (e.g., a loading dock deck with an overhanging roof).

As mentioned above, the K-factor of the sprinkler in one embodiment is 5.6, which provides a significant decrease in system flow and pressure requirements with respect to higher K-factor sprinklers in hallway and deck applications. For example, for a coverage area of 28 ft wide by 10 ft (forward throw in the output direction), the sprinkler of the present invention requires a pressure of less than about 25 psi and flow rate of less than about 28 gpm. For a coverage area of 28 ft wide by 8 ft, the sprinkler requires a pressure of less than about 17 psi and flow rate of less than about 23 gpm. By contrast, a sidewall sprinkler with a K-factor of 8.0 and a coverage area of 28 ft wide by 14 ft may require a pressure of 25 psi and a flow rate of 40 gpm.

While the sprinkler 100 has been shown and described with reference to FIGS. 1-6, alternate arrangements of the sprinkler 100 are contemplated by the inventors. For example, it is contemplated by the inventors to use the sprinkler 100 in a recessed configuration in a wall using a suitable escutcheon (not shown). Two examples of such a recessed horizontal sprinkler are model DH56 FP and DH56 F2 recessed sprinklers, manufactured by The Reliable Automatic Sprinkler Co., Inc. (Liberty, S.C.), which employ, respectively, series FP and F2 escutcheons manufactured by the same manufacturer. It is also contemplated by the inventors to use the sprinkler 300 (see below) in a concealed configuration in a wall using a suitable cover and escutcheon arrangement. An example of such a concealed horizontal sprinkler is model SWC sidewall concealed sprinkler manufactured by The Reliable Automatic Sprinkler Co., Inc. It is also contemplated that the sprinkler 100, alone or in its contemplated recessed or concealed configurations, is used as a sprinkler element of a horizontal dry sprinkler. An example of such a dry sprinkler configuration is model DH56 Dry manufactured by The Reliable Automatic Sprinkler Co., Inc.

In addition to extended coverage light hazard (ECLH) protection, the inventors have discovered that the aforementioned deflector 200 can also be employed to provide extended coverage ordinary hazard (ECOH) sprinkler protection under certain operating conditions discussed hereinbelow.

Figure 7:
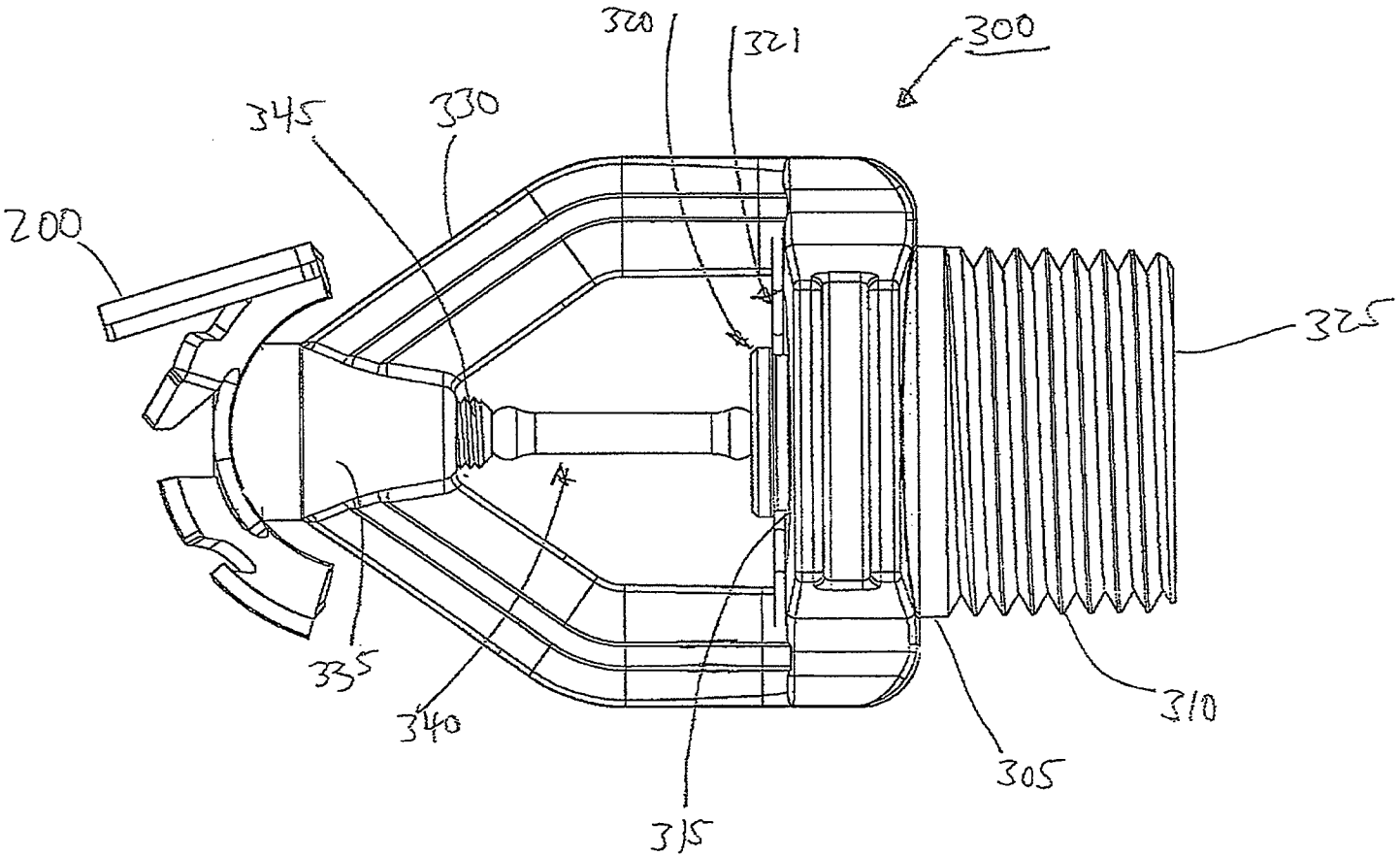
FIG. 7 is a side elevation view of another embodiment of a horizontal sidewall sprinkler according to the present invention.
Figure 8:
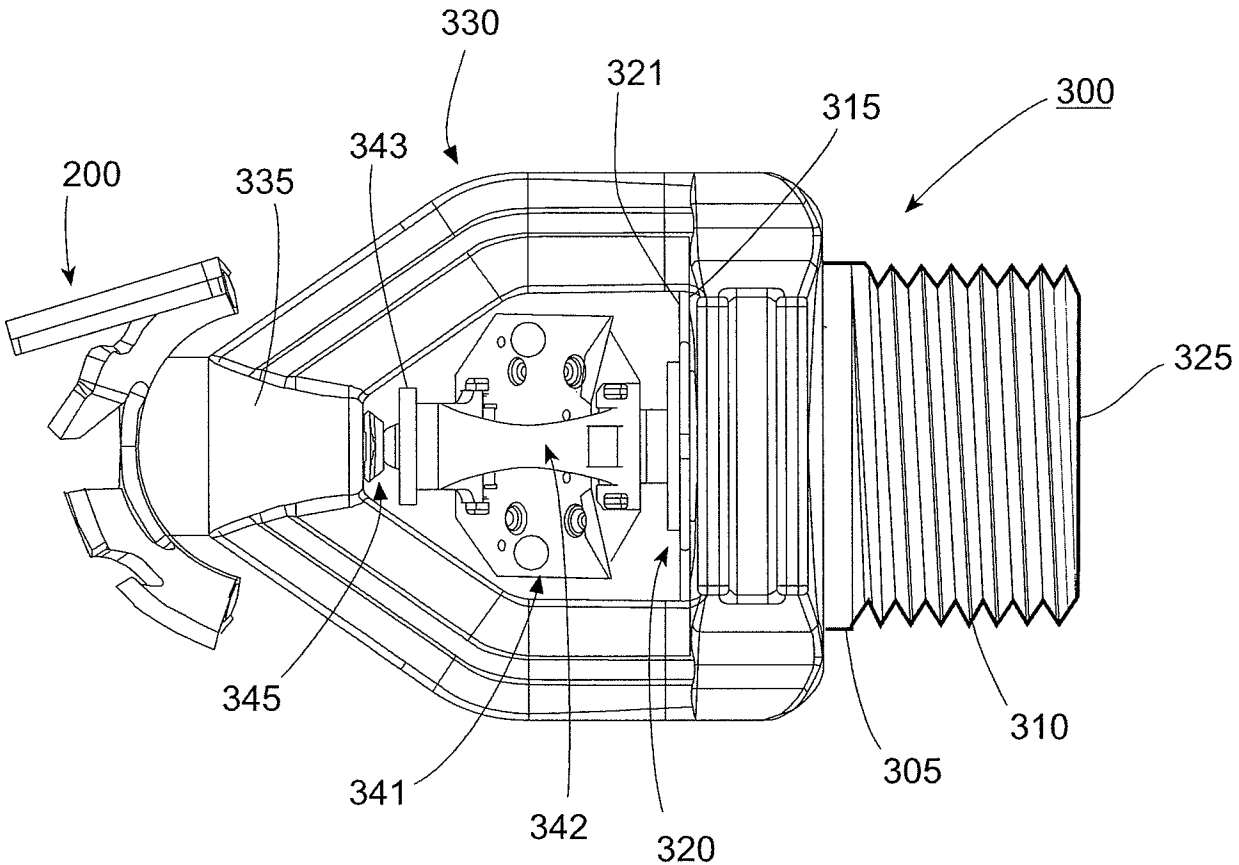
FIG. 8 is a side elevation view of the horizontal sidewall sprinkler shown in FIG. 7, but with an alternative release mechanism.

FIGS. 7 and 8 show alternative embodiments of a horizontal sidewall ECLH/ECOH sprinkler 300, which is configured to extend horizontally from a wall (not shown), a predetermined distance below the ceiling. The sprinkler 300 has a body 305 defining an axial fluid passage having a horizontal output direction, which is perpendicular to the wall. The body 305 has a threaded portion 310 on its outer surface to allow the sprinkler 300 to be connected to a conduit (not shown) for providing pressurized fire-extinguishing fluid, such as water, to an input end 325 of the fluid passage. The fluid passage has an output orifice 315 at the opposite end that is sealed by a seal cap 320. The seal cap 320 is biased in the output direction by a biasing member 321, such as, for example, a spring washer. The input end 325 of the fluid passage may have a diameter of, for example, ¾ inch NPT (national pipe thread). The sprinkler 300 may have a K-factor greater than 5.6, such as, for example, 8, 11.2, or 14. In fact, however, these embodiments are operable at a full range of K-factors, from 2.8 or below, up to 15 or 16, or higher. As stated above, the use of K-factors toward the lower or upper ends of this range may be less attractive due to required water pressures.

Two frame arms 330 extend from the body 305 in a vertical plane perpendicular to the wall and meet at a hub 335 positioned in front of and in axial alignment with the output orifice 315. The deflector 200 is positioned on the hub 335 so as to be impinged by the output fluid upon activation of the sprinkler 300. As further discussed below, the deflector 200 is centered on hub 335 and has a generally horizontal orientation, along an axis (not shown) transverse to the output direction of the sprinkler 300. As shown in FIGS. 7 and 8, the deflector 200 is curved along that transverse axis toward the output orifice 315. The construction and dimensions of the deflector 200 described hereinabove with respect to FIGS. 1-6 also apply to the deflector 200 used in the ECOH sprinkler. Accordingly, for the sake of brevity, the dimensional details of the deflector 200 are not repeated.

As shown in FIG. 7, a release mechanism having a thermally-responsive element, e.g., a frangible bulb 340, is positioned between the hub 335 and the seal cap 320 to hold the seal cap 320 in place over the output orifice 315. As shown in the elevation view of FIG. 7, the bulb 340 is positioned between the seal cap 320 and a set screw 345. The bulb 340 bursts at the predetermined temperature, which in turn releases the seal cap 320 and allows the fluid to be output from the orifice 315. Of course, other types of release mechanisms may be used, including, but not limited to, for example, an assembly formed by a fusible link, strut, and lever. An example of an alternate sprinkler arrangement is shown in FIG. 8, where a fusible link 341, strut 342, and lever 343 are used in place of the bulb 340 shown in FIG. 7. The bulb 340 may be configured to burst at one of various temperatures, including 155 and 200 degrees Fahrenheit. The link 341 may be configured to separate at one of various temperatures, including 165 and 212 degrees Fahrenheit.

The raised portion 215 of the deflector 200 is aligned with the frame arms 330 and in the specific embodiment shown in FIGS. 7 and 8, the raised portion 215 is spaced from the frame arms 330. The circular portion 220 is provided in the center of the central portion 210 of the deflector to allow the deflector 200 to be attached to the end of the hub 335.

As described above with respect to the embodiment of the sprinkler shown in FIGS. 1-6, the planar portions 250 of the deflector 200 help project fluid to the sides in a diagonal direction toward the corners of the spray pattern, thereby forming a wide rectangular pattern, while maintaining the desired density (e.g., ordinary hazard 2, 0.2 gpm/ft$^2$) throughout the coverage area. For example, the sprinkler may be used as an extended coverage sidewall sprinkler at a wall spacing of 28 feet and a forward throw of 14 feet.

Table 1 summarizes data observed from testing one embodiment of the sprinkler 300 having a K-factor of 14 with water at various operating conditions and coverage areas. The data indicates that the sprinkler 300 can provide both ECLH and ECOH protection for coverage areas that are up to 28 feet by 20 feet. More specifically, the sprinkler 300 is able to distribute water in a rectangular spray pattern that is 28 feet wide and between 14 and 20 feet from the wall, resulting in coverage areas between 392 and 560 square feet at the required coverage densities for ECLH and ECOH protection. Such spray patterns are particularly useful in long, relatively narrow spaces, such as hallways or decks (e.g., a loading dock deck with an overhanging roof). While the current NFPA 13 standard limits the coverage area for a single sprinkler to 400 square feet, the data in Table 1 indicates that a single sprinkler constructed in accordance with this application may provide ECLH/ECOH protection for a coverage area exceeding 400 square feet.

TABLE 1

| | | | | Ordinary Hazard | | | |
|---|---|---|---|---|---|---|---|
| | Area of | Light Hazard (0.1 gpm/ft$^2$) | | Ordinary Hazard 1 (0.15 gpm/ft$^2$) | | Ordinary Hazard 2 (0.2 gpm/ft$^2$) | |
| Spacing ft × ft | Coverage (ft$^2$) | Flow (gpm) | Pressure (psi) | Flow (gpm) | Pressure (psi) | Flow (gpm) | Pressure (psi) |
| 28' × 14' | 392 | 40 | 8.2 | 60 | 18.4 | 80 | 32.7 |
| 28' × 16' | 448 | 45 | 10.3 | 68 | 23.6 | 90 | 41.3 |
| 28' × 18' | 504 | 50 | 12.8 | 76 | 29.5 | 102 | 53.1 |
| 28' × 20' | 560 | 56 | 16.0 | 84 | 36.0 | 112 | 64.0 |

In a preferred embodiment, the body 305 of the sprinkler 300 shown in FIGS. 7 and 8 is formed substantially like that of model JL112 ECOH pendent sprinkler manufactured by The Reliable Automatic Sprinkler Co. While the model JL112 ECOH is manufactured with a K-factor of 11.2, in one example embodiment of the sprinkler 300, the body 305 is modified so that the nominal K-factor of the sprinkler 300 is 14. Of course, other modifications to the orifice size of the JL112 sprinkler are within the scope of this disclosure.

Moreover, it is contemplated by the inventors to use the sprinkler 300 in a recessed configuration in a wall using a suitable escutcheon (not shown), such as series F1, F2, and FP escutcheons manufactured by The Reliable Automatic Sprinkler Co., Inc. It is also contemplated by the inventors to use the sprinkler 300 in a concealed configuration in a wall using a suitable cover and escutcheon arrangement used on model SWC sidewall concealed sprinkler manufactured by The Reliable Automatic Sprinkler Co., Inc. (Liberty, S.C.). It is also contemplated that the sprinkler 300, alone or in its contemplated recessed or concealed configurations, is used as the sprinkler element of a horizontal dry sprinkler, such as the model F3QR dry sprinkler manufactured by The Reliable Automatic Sprinkler Co., Inc. (Liberty, S.C.).

While the data in Table 1 corresponds to testing of a sprinkler 300 configured as described above having a nominal K-factor of 14, the inventors believe that other embodiments of sprinklers having K-factors less than 14, such as between 5.6 and 14, or between 2.9 and 5.6, will provide at least the same protection coverage, albeit at higher pressures than shown in Table 1. Moreover, it is expected that sprinklers having a K-factor greater than 14 can be used with the deflector 200 to provide at least the same protection coverage at the spacings in the table below, albeit at lower pressures than shown in Table 1.

Sprinklers according to the present disclosure can be made from any of the materials conventionally used for fire prevention sprinklers. In addition, however, other materials may be used. Examples of such other materials include alloy 2745 and ECO Brass, used for the bodies and caps. Other examples are to form the sprinkler body out of a plastic material or to make it out of a conventional metal with the entire interior (water-exposed) surface coated with a plastic to prevent the release into the water of any lead or other harmful material present in the metal itself. Similarly, it is also contemplated to form the sprinkler body out of a vitreous material or to make it out of a conventional metal with the entire interior (water-exposed) surface coated with such a vitreous material to prevent the release into the water of any lead or other harmful material present in the metal itself.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A sidewall fire protection sprinkler, comprising:

a body defining an input passage having an input and an output orifice sealed with a seal cap; and a deflector attached to the body, the deflector comprising:

a central portion curved about a first, horizontal axis that is transverse to a second axis that extends in an output direction of the sprinkler;

end portions extending outwardly from the central portion along the first axis, the end portions each respectively including an upper part and a lower part separated by a gap which defines an elongated notch extending between the upper part and the lower part at an innermost portion of the gap adjacent to the central portion, wherein the gap is formed extending outwardly from the central portion substantially along the first axis; and planar portions extending respectively from top edges of the upper parts of the end portions, wherein the planar portions extend in the output direction, wherein the sprinkler has a nominal K-factor in a range from about 2.8 to about 16.

2. The sidewall fire protection sprinkler of claim 1, wherein the planar portions are angled downward with respect to the first axis.

3. The sidewall fire protection sprinkler of claim 1, wherein the planar portions are angled downward with respect to the second axis.

4. The sidewall fire protection sprinkler of claim 1, wherein a width of the planar portions along the first axis is substantially less than a width of the end portions along the first axis.

5. The sidewall fire protection sprinkler of claim 1, wherein the planar portions extend in the output direction beyond the top edges between the planar portions and the upper parts.

6. The sidewall fire protection sprinkler of claim 1, wherein the end portions are curved about the-first axis with a radius increasing in a direction away from the central portion.

7. The sidewall fire protection sprinkler of claim 1, wherein the lower parts of the end portions have an open-ended slot that is angled with respect to the first axis.

8. The side wall fire protection sprinkler of claim 1, wherein the nominal K-factor is greater than about 5.6.

9. The sidewall fire protection sprinkler of claim 8, wherein the nominal K-factor of the sprinkler is one of 8, 11.2, and 14.

10. The sidewall fire protection sprinkler of claim 8, wherein, the nominal K-factor of the sprinkler is 14 and for a coverage area of 28 ft along a wall by 14 ft forward throw, the sprinkler requires a system pressure of less than about 33 psi and flow rate of less than about 80 gpm.

11. The sidewall fire protection sprinkler of claim 8, wherein, the nominal K-factor of the sprinkler is 14 and for a coverage area of 28 ft along a wall by 16 ft forward throw, the sprinkler requires a system pressure of less than about 42 psi and flow rate of less than about 90 gpm.

12. The sidewall fire protection sprinkler of claim 8, wherein, the nominal K-factor of the sprinkler is 14 and for a coverage area of 28 ft along a wall by 18 ft forward throw, the sprinkler requires a system pressure of less than about 54 psi and flow rate of less than about 102 gpm.

13. The sidewall fire protection sprinkler of claim 8, wherein, the nominal K-factor of the sprinkler is 14 and for a coverage area of 28 ft along a wall by 20 ft forward throw, the sprinkler requires a system pressure of less than about 64 psi and flow rate of less than about 112 gpm.

14. The sidewall fire protection sprinkler of claim 1, wherein the notch is formed in both the upper and lower part.

15. The sidewall fire protection sprinkler of claim 1, wherein the gap extends in a direction that is substantially orthogonal to the notch.

16. The sidewall fire protection sprinkler of claim 1, wherein an open area of the notch is coextensive with that of the gap.

17. The sidewall fire protection sprinkler of claim 15, wherein the gap is defined by a tab extending downwardly from the upper part.

18. A recessed sidewall fire protection sprinkler comprising:

a body defining an input passage having an input and an output orifice sealed with a seal cap;

a deflector attached to the body, the deflector comprising:

a central portion curved about a first, horizontal axis that is transverse to a second axis that extends in an output direction of the sprinkler, end portions extending outwardly from the central portion along the first axis, the end portions each respectively including an upper part and a lower part separated by a gap which defines an elongated notch extending between the upper part and the lower part at an innermost portion of the gap adjacent to the central portion, wherein the gap is formed extending outwardly from the central portion substantially along the first axis, and planar portions extending respectively from top edges of the upper parts of the end portions, wherein the planar portions extend in the output direction; and an escutcheon attached to the body.

19. The recessed sidewall fire protection sprinkler according to claim 18, wherein the nominal K-factor of the sprinkler is in the range from about 2.8 to about 16.

20. The recessed sidewall fire protection sprinkler of claim 19, wherein the nominal K-factor of the sprinkler is one of 8, 11.2, and 14.

21. The recessed sidewall fire protection sprinkler of claim 18, wherein, the nominal K-factor of the sprinkler is 14 and for a coverage area of 28 ft along a wall by 14 ft forward throw, the sprinkler requires a system pressure of less than about 33 psi and flow rate of less than about 80 gpm.

22. The recessed sidewall fire protection sprinkler of claim 18, wherein, the nominal K-factor of the sprinkler is 14 and for a coverage area of 28 ft along a wall by 16 ft forward throw, the sprinkler requires a system pressure of less than about 42 psi and flow rate of less than about 90 gpm.

23. The recessed sidewall fire protection sprinkler of claim 18, wherein, the nominal K-factor of the sprinkler is 14 and for a coverage area of 28 ft along a wall by 18 ft forward throw, the sprinkler requires a system pressure of less than about 54 psi and flow rate of less than about 102 gpm.

24. The recessed sidewall fire protection sprinkler of claim 18, wherein, the nominal K-factor of the sprinkler is 14 and for a coverage area of 28 ft along a wall by 20 ft forward throw, the sprinkler requires a system pressure of less than about 64 psi and flow rate of less than about 112 gpm.

25. A dry sidewall fire protection sprinkler comprising:

a body defining an input passage having an input and an output orifice sealed with a seal cap;

a deflector attached to the body, the deflector comprising:

a central portion curved about a first, horizontal axis that is transverse to a second axis that extends in an output direction of the sprinkler, end portions extending outwardly from the central portion along the first axis, the end portions each respectively including an upper part and a lower part separated by a gap which defines an elongated notch extending between the upper part and the lower part at an innermost portion of the gap adjacent to the central portion, wherein the gap is formed extending outwardly from the central portion substantially along the first axis, and planar portions extending respectively from top edges of the upper parts of the end portions, wherein the planar portions extend in the output direction;

an escutcheon attached to the body; and a cover attached to the escutcheon to conceal the deflector and the body.

26. The dry sidewall fire protection sprinkler according to claim 25, wherein the nominal K-factor of the sprinkler is in the range from about 2.8 to about 16.

27. The dry sidewall fire protection sprinkler of claim 25, wherein the nominal K-factor of the sprinkler is one of 8, 11.2, and 14.

28. The dry sidewall fire protection sprinkler of claim 26, wherein the nominal K-factor of the sprinkler is 14, and for a coverage area of 28 ft along a wall by 14 ft forward throw, the sprinkler requires a system pressure of less than about 33 psi and flow rate of less than about 80 gpm.

29. The dry sidewall fire protection sprinkler of claim 26, wherein the nominal K-factor of the sprinkler is 14, and for a coverage area of 28 ft along a wall by 16 ft forward throw, the sprinkler requires a system pressure of less than about 42 psi and flow rate of less than about 90 gpm.

30. The dry sidewall fire protection sprinkler of claim 26, wherein the nominal K-factor of the sprinkler is 14, and for a coverage area of 28 ft along a wall by 18 ft forward throw, the sprinkler requires a system pressure of less than about 54 psi and flow rate of less than about 102 gpm.

31. The dry sidewall fire protection sprinkler of claim 26, wherein the nominal K-factor of the sprinkler is 14, and for a coverage area of 28 ft along a wall by 20 ft forward throw, the sprinkler requires a system pressure of less than about 64 psi and flow rate of less than about 112 gpm.

* * * * *